US007801277B2

(12) United States Patent
Zou et al.

(10) Patent No.: US 7,801,277 B2
(45) Date of Patent: Sep. 21, 2010

(54) FIELD EMITTER BASED ELECTRON SOURCE WITH MINIMIZED BEAM EMITTANCE GROWTH

(75) Inventors: Yun Zou, Clifton Park, NY (US); Yang Cao, Niskayuna, NY (US); Louis Paul Inzinna, Scotia, NY (US); Vasile Bogdan Neculaes, Niskayuna, NY (US)

(73) Assignee: General Electric Company, Niskayuna, NY (US)

( * ) Notice: Subject to any disclaimer, the term of this patent is extended or adjusted under 35 U.S.C. 154(b) by 0 days.

(21) Appl. No.: 12/055,536

(22) Filed: Mar. 26, 2008

(65) Prior Publication Data

US 2009/0245468 A1 Oct. 1, 2009

(51) Int. Cl.

| | |
|---|---|
| ***G21B 4/00*** | (2006.01) |
| ***H01J 35/14*** | (2006.01) |
| ***H01J 35/02*** | (2006.01) |
| ***H01J 35/00*** | (2006.01) |

(52) U.S. Cl. ..... 378/122; 378/119; 378/138

(58) Field of Classification Search ..... 378/119, 378/121, 122, 136, 138

See application file for complete search history.

(56) References Cited

U.S. PATENT DOCUMENTS

| | | | | |
|---|---|---|---|---|
| 4,032,815 | A * | 6/1977 | Haflinger | 315/14 |
| 4,521,901 | A | 6/1985 | Rand | |
| 6,404,149 | B1 * | 6/2002 | Ueno et al. | 315/382 |
| 6,553,096 | B1 | 4/2003 | Zhou et al. | |
| 6,570,320 | B1 * | 5/2003 | Burkhardt et al. | 313/495 |
| 6,876,724 | B2 | 4/2005 | Zhou et al. | |
| 2001/0015610 | A1 * | 8/2001 | Park | 313/412 |
| 2002/0047670 | A1 * | 4/2002 | Ono | 315/386 |
| 2005/0175151 | A1 | 8/2005 | Dunham et al. | |
| 2006/0274889 | A1 * | 12/2006 | Lu et al. | 378/122 |
| 2007/0237300 | A1 * | 10/2007 | Kim et al. | 378/122 |
| 2008/0043920 | A1 * | 2/2008 | Liu et al. | 378/138 |

OTHER PUBLICATIONS

Liu et al., "Development of a carbon nanotube based microfocus x-ray tube with single focusing electrode," Review of Scientific Instruments 77, 054302, pp. 1-6, 2006, http://rsi.aip.org/rsi/copyright.jsp.

Lalush et al., "Tomosynthesis Reconstruction From Multi-Beam X-Ray Sources," IEEE, pp. 1180-1183, 2006.

Zou et al., "Theoretical study of transverse emittance growth in a gridded electron gun," Nuclear Instruments and Methods In Physics Research A 519, pp. 432-441, 2004.

* cited by examiner

*Primary Examiner*—Edward J Glick
*Assistant Examiner*—Anastasia Midkiff
(74) *Attorney, Agent, or Firm*—Scott J. Asmus

(57) ABSTRACT

A system and method for limiting emittance growth in an electron beam is disclosed. The system includes an emitter element configured to generate an electron beam and an extraction electrode positioned adjacent to the emitter element to extract the electron beam out therefrom, the extraction electrode including an opening therethrough. The system also includes a meshed grid disposed in the opening of the extraction electrode to enhance intensity and uniformity of an electric field at a surface of the emitter element and an emittance compensation electrode (ECE) positioned adjacent to the meshed grid on the side of the meshed grid opposite that of the emitter element and configured to control emittance growth of the electron beam.

22 Claims, 5 Drawing Sheets

FIG. 1
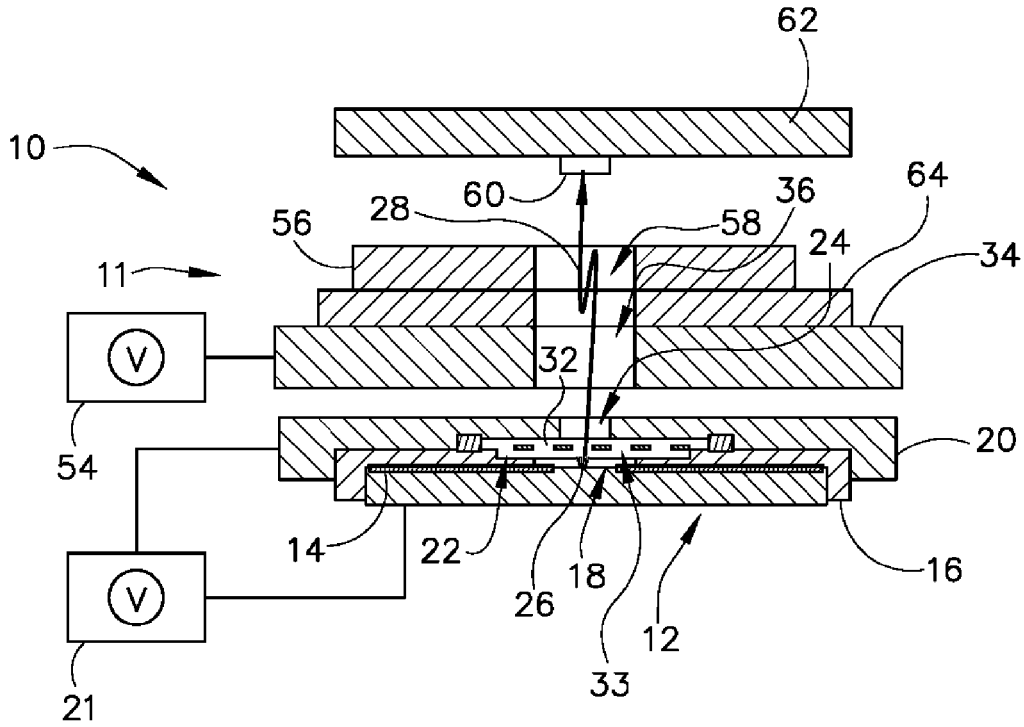
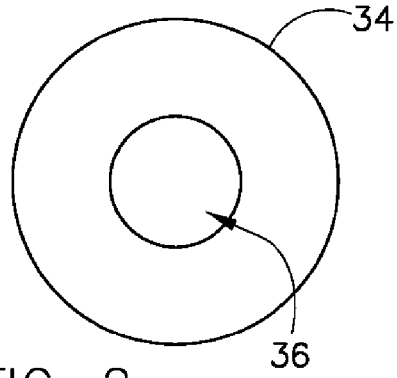
FIG. 2
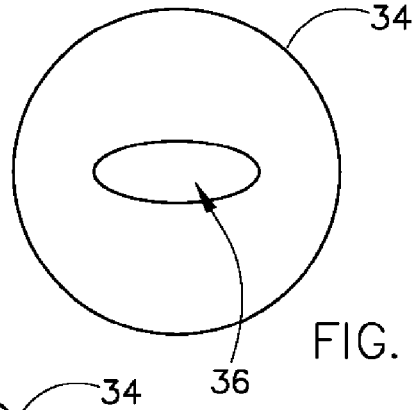
FIG. 4
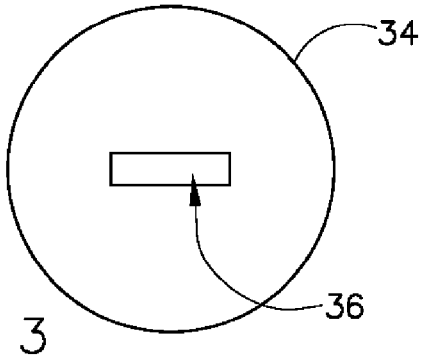
FIG. 3

FIELD EMITTER BASED ELECTRON SOURCE WITH MINIMIZED BEAM EMITTANCE GROWTH

BACKGROUND OF THE INVENTION

The present invention relates generally to field-type electron emitters, and, more particularly, to a system for limiting emittance growth in an electron beam. A field emitter unit includes an emittance compensation electrode that functions to minimize degradation of the electron beam and allow for focusing of the electron beam into a desired spot size.

Electron emissions in field-type electron emitter arrays are produced according to the Fowler-Nordheim theory relating the field emission current density of a metal surface to the electric field at the surface. Most field-type electron emitter arrays generally include an array of many field emitter devices. Emitter arrays can be micro- or nano-fabricated to contain tens of thousands of emitter devices on a single chip. Each emitter device, when properly driven, can emit a beam or current of electrons from the tip portion of the emitter device. Field emitter arrays have many applications, one of which is as electron sources in microwave tubes, x-ray tubes, and other microelectronic devices.

The electron-emitting field emitter devices themselves may take a number of forms, such as a "Spindt"-type emitter. In operation, a control voltage is applied across a gating/extraction electrode and substrate to create a strong electric field and extract electrons from an emitter element placed on the substrate. Typically, the gate layer is common to all emitter devices of an emitter array and supplies the same control or emission voltage to the entire array. In some Spindt emitters, the control voltage may be about 100V. Other types of emitters may include refractory metal, carbide, diamond, or silicon tips or cones, silicon/carbon nanotubes, metallic nanowires, carbon fibers, or carbon nanotubes.

When used as an electron source in an x-ray tube application, it is desirable to lower the voltage necessary for the field emitter elements to generate an electron beam, so as to lower the probability of breakdown caused by operational failures and structural wear associated with an overvoltage being applied to the gate layer. Thus, certain mechanisms are employed to lower the voltage needed for extracting an electron beam from the cathode, with one such mechanism being a grid structure. A grid structure functions to enhance the electric field strength at the surface of the emitter element, thus lowering the necessary extraction voltage. However, while the grid mesh significantly improves the extraction efficiency, it also has a negative impact on electron beam quality due to the interaction of the electron beam with the grid. That is, interaction of the electron beam with the grid can increase the degradation of the electron beam quality by increasing beam emittance, which prevents the electron beam from focusing onto a small, useable focal spot on the anode.

Thus, a need exists for a system that minimizes emittance growth in the electron beam due to the extraction grid and is able to achieve continuously controlled beam focusing. It would also be desirable to have a system that allows for modulation of the electron beam current while controlling emittance growth in the electron beam.

BRIEF DESCRIPTION OF THE INVENTION

Embodiments of the invention overcome the aforementioned drawbacks by providing a field emitter unit that provides low voltage extraction and minimal emittance growth in the electron beam. The field emitter unit includes an emittance compensation electrode that functions to minimize degradation of the electron beam and allow for focusing of the electron beam into a desired spot size.

According to one aspect of the invention, an electron gun includes an emitter element configured to generate an electron beam and an extraction electrode positioned adjacent to the emitter element to extract the electron beam out therefrom, the extraction electrode including an opening therethrough. The electron gun also includes a meshed grid disposed in the opening of the extraction electrode to enhance intensity and uniformity of an electric field at a surface of the emitter element and an emittance compensation electrode (ECE) positioned adjacent to the meshed grid on the side of the meshed grid opposite that of the emitter element and configured to control emittance growth of the electron beam.

According to another aspect of the invention, a cathode assembly for an x-ray source includes a substrate, an extraction element positioned adjacent to the substrate and having an opening with a meshed grid positioned therein, and an insulating layer between the substrate and the extraction element, the insulating layer having a cavity generally aligned with the opening in the extraction element. The cathode assembly also includes a field emitter element disposed in the cavity of the insulating layer and configured to emit a stream of electrons when an emission voltage is applied across the extraction element and an emittance compensation electrode (ECE) positioned downstream from the extraction element and configured to compress the electron beam in space and momentum phase space.

According to yet another aspect of the invention, a multiple spot x-ray source includes a plurality of field emitter units configured to generate at least one electron beam and a target anode positioned in a path of the at least one electron beam and configured to emit a beam of high-frequency electromagnetic energy conditioned for use in a CT imaging process when the electron beam impinges thereon. Each of the plurality of field emitter units includes a carbon nanotube (CNT) emitter element and a gate electrode to extract the electron beam from the CNT emitter element, the gate electrode including a meshed grid positioned in the electron beam path. Each of the plurality of field emitter units further includes a focusing element positioned to receive the electron beam from the emitter element and focus the electron beam to form a focal spot on the target anode and an emittance compensation electrode (ECE) positioned between the meshed grid and the focusing element and configured to control electron beam emittance growth.

These and other advantages and features will be more readily understood from the following detailed description of preferred embodiments of the invention that is provided in connection with the accompanying drawings.

BRIEF DESCRIPTION OF THE DRAWINGS

The drawings illustrate embodiments presently contemplated for carrying out the invention.

In the drawings:

FIG. 1 is a cross-sectional view of a field emitter unit and target anode in accordance with an embodiment of the present invention.

FIG. 2 is a top plan view of an emittance compensation electrode (ECE) in accordance with an embodiment of the present invention.

FIG. 3 is a top plan view of an emittance compensation electrode (ECE) in accordance with another embodiment of the present invention.

FIG. 4 is a top plan view of an emittance compensation electrode (ECE) in accordance with another embodiment of the present invention.

DETAILED DESCRIPTION OF THE INVENTION

Figure 5:
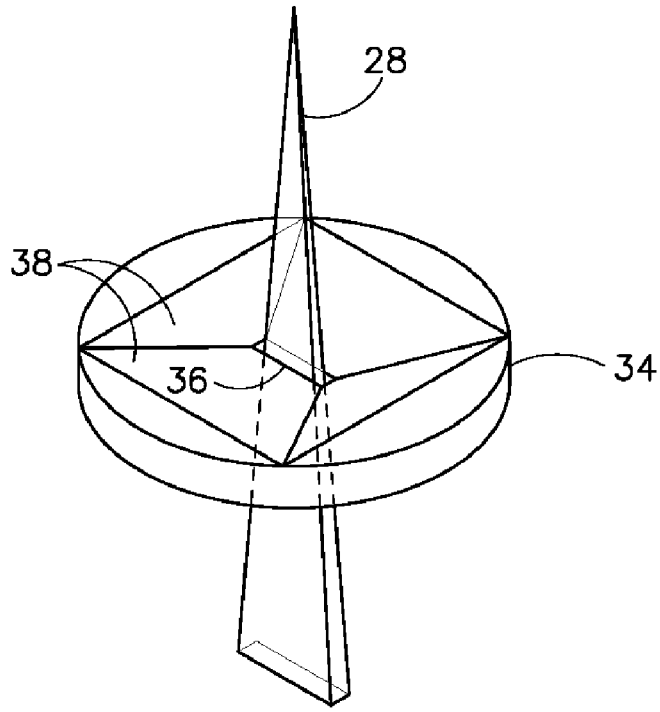
FIG. 5 is a perspective view of an emittance compensation electrode (ECE) in accordance with another embodiment of the present invention.

The operating environment of embodiments of the invention is described with respect to an electron gun and x-ray source that includes a field emitter based cathode. That is, the electron beam emission and electron beam compression schemes of the invention are described as being provided for an electron gun and field emitter based x-ray source. However, it will be appreciated by those skilled in the art that embodiments of the invention for such electron beam emission and electron beam compression schemes are equally applicable for use with other cathode technologies, such as dispenser cathodes and other thermionic cathodes. The invention will be described with respect to a field emitter unit, but is equally applicable with other cold cathode and/or thermionic cathode structures.

Referring to FIG. 1, a cross-sectional view of a single electron generator 10 (i.e., electron gun) is depicted according to one embodiment of the invention. As will be explained in greater detail below, in one embodiment, electron generator 10 is a cold cathode, carbon nanotube (CNT) field emitter. However, it is understood that the features and adaptations described herein are also applicable to other types of field emitters, such as Spindt-type emitters, or other thermionic cathode or dispenser cathode type electron generators. As shown in FIG. 1, electron generator 10 comprises a field emitter unit 11 having a base or substrate layer 12 that is preferably formed of a conductive or semiconductive material such as a doped silicon-based substance or of copper or stainless steel. Therefore, substrate layer 12 is preferably rigid. A dielectric film 14 is formed or deposited over substrate 12 to separate an insulating layer 16 (i.e., ceramic spacer) therefrom. Dielectric film 14 is preferably formed of a non-conductive substance or a substance of a very high electrical resistance, such as silicon dioxide ($SiO_2$) or silicon nitride ($Si_3N_4$), or some other material having similar dielectric properties. A channel or aperture 18 is formed in dielectric film 14 by any of several known chemical or etching manufacturing processes.

Substrate layer 12 is registered onto insulating layer 16, which in one embodiment is a ceramic spacer element having desired insulating properties as well as compressive properties for absorbing loads caused by translation of the field emitter unit (e.g., when the field emitter unit forms part of an x-ray source that rotates about a CT gantry). Insulating layer 16 is used to separate the substrate layer 12 from an extraction electrode 20 (i.e., gate electrode, gate layer), so that an electrical potential may be applied between extraction electrode 20 and substrate 12 by way of a voltage supplied by controller 21. A channel or cavity 22 is formed in insulating layer 16, and a corresponding opening 24 is formed in extraction electrode 20. As shown, opening 24 substantially overlaps cavity 22. In other embodiments, cavity 22 and opening 24 may be of approximately the same diameter, or cavity 22 may be narrower than opening 24 of gate layer extraction electrode 20.

An electron emitter element 26 is disposed in cavity 22 and affixed on substrate layer 12. The interaction of an electrical field in opening 22 (created by extraction electrode 20) with the emitter element 26 generates an electron beam 28 that may be used for a variety of functions when a control voltage is applied to emitter element 26 by way of substrate 12. In one embodiment, emitter element 26 is a carbon nanotube-based emitter; however, it is contemplated that the system and method described herein are also applicable to emitters formed of several other materials and shapes used in field-type emitters.

Referring still to FIG. 1, a meshed grid 32 is positioned between cavity 22 of insulating layer 16 and opening 24 of extraction electrode 20. This positions meshed grid 32 in proximity to emitter element 26 to reduce the voltage needed to extract electron beam 28 from emitter element 26. That is, for efficient extraction, a gap 33 between meshed grid 32 and emitter element 26 is kept within a desired distance (e.g., 0.1 mm to 2 mm) in order to enhance the electric field around emitter element 26 and minimize the total extracting voltage supplies by controller 21 that is necessary to extract electron beam 28. Placement of meshed grid 32 over cavity 22 allows for an extraction voltage applied to extraction electrode 20 in the range of approximately 1-3 kV, depending on the distance between meshed grid 32 and emitter element 26. By reducing the total extracting voltage to such a range, high voltage stability of field emitter unit 10 is improved, and higher emission current in electron beam 28 is made possible. The difference in potential between emitter element 26 and extraction electrode 20 is minimized to reduce high voltage instability in emitter unit 10 and simplify the need for complicated driver/control design therein.

Also included in field emitter unit 10 is an emittance compensation electrode (ECE) 34 that is positioned adjacent to meshed grid 32 on an opposite side from emitter element 26 so as to receive electron beam 28 upon exiting the extraction electrode 20. The ECE 34 is positioned adjacent to meshed grid 32 and functions to minimize beam emittance growth in electron beam 28 caused by the passing of the beam through the meshed grid 32. That is, the extent of space and momentum phase space (i.e., emittance) occupied by the electrons of electron beam 28 is controlled and minimized by ECE 34.

The ECE 34 includes an aperture 36 formed therein through which electron beam 28 passes. As shown in FIGS. 2-4, aperture 36 can be any of a variety of shapes, so as to compress and shape electron beam 28. For example, aperture 36 can be in the form of a circular (FIG. 2), rectangular (FIG. 3), or elliptical (FIG. 4) shape. It is envisioned that the shape of aperture 36 generally corresponds to the cross-sectional profile of electron beam 28. Additionally, and as shown in FIG. 5, ECE 34 can be formed so as to have angled surfaces 38 thereon, such that aperture 36 comprises an angled opening. The angled surfaces 38 formed about aperture 36 function to provide further improved compression on electron beam 28 and further minimize beam emittance.

Figure 6:
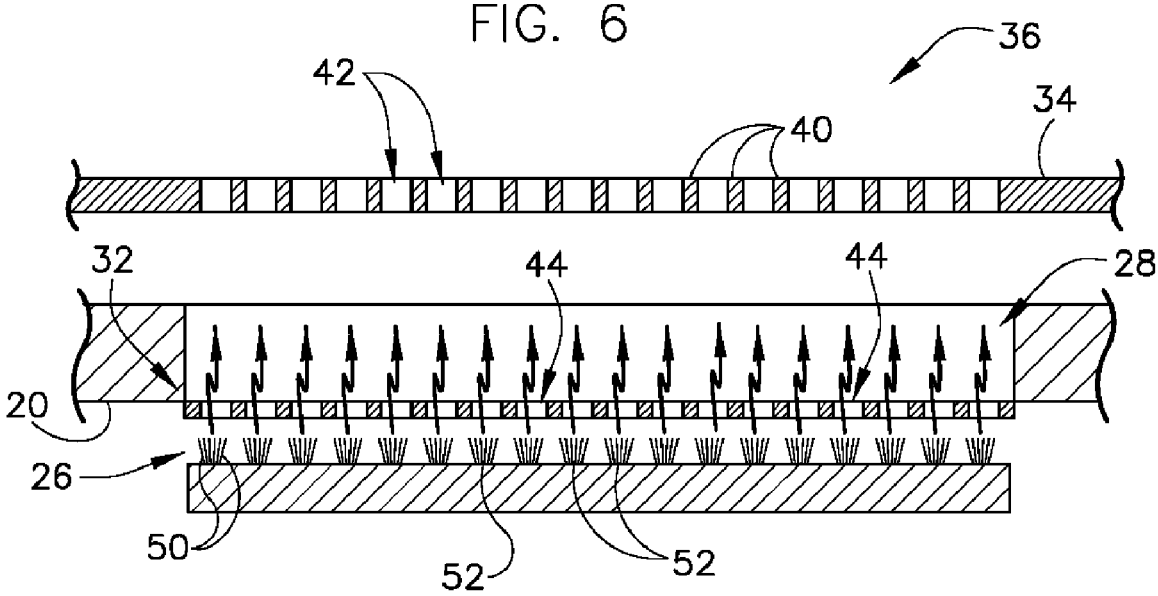
FIG. 6 is a partial cross-sectional view of a field emitter unit in accordance with an embodiment of the present invention.

In another embodiment, and as shown in FIG. 6, a secondary grid 40 is positioned in aperture 36 of ECE 34. The secondary grid 40 generates an enhanced electrostatic field across aperture 36, providing for greater flexibility in the compression of electron beam 28. In order to prevent secondary grid 40 from adversely affecting electron beam quality, a plurality of openings 42 in secondary grid 40 are precisely aligned with openings 44 in meshed grid 32 of extraction electrode 20 along a path of the electron beam 28. Such an alignment minimizes interaction of electron beam 28 with the secondary grid 40.

As also shown in FIG. 6, emitter element 26 is comprised of a plurality of carbon nanotubes (CNTs) 50. To reduce the attenuation of electron beam 28 caused by the striking of electrons against meshed grid 32 and secondary grid 40, CNTs 50 are patterned into multiple CNT groups 52 that are aligned with openings 42, 44 in both grids. By aligning CNT groups 52 with openings 42, 44 in meshed grid 32 and secondary grid 40, interception of beam current in electron beam 28 can be reduced to almost zero, depending on the grid structures. Also, by aligning CNT groups 52 with openings 42, 44, a substantially higher fraction of electrons will pass through the grids 32, 40, thus increasing the total beam emission current and allowing for optimal focusing of electron beam 28 for forming a desired focal spot.

Referring again to FIG. 1, an electrostatic field is generated across aperture 36 by application of a voltage (i.e., a compression voltage) to ECE 34 by way of a controller 54 that is a separate device from controller 21. The electrostatic field interacts with electron beam 28 such that electrons in electron beam 28 are confined to a small distance in a transverse direction and have nearly the same momentum (i.e., "compressing" electron beam 28). Such spatial confinement and uniformity in momentum of the electrons reduces emittance growth in electron beam 28. The voltage applied to ECE 34 by controller 54 typically ranges from about 4 kV to 20 kV, although it is envisioned that lesser or greater voltages can also be applied. Furthermore, the voltage applied to ECE 34 can be either a constant voltage or can be varied, as explained in greater detail below. That is, in one embodiment, a voltage applied to ECE 34 corresponds to an extraction voltage applied to extraction electrode 20 and meshed grid 32 (and to substrate 12) for extracting electron beam 28 from emitter element 26. Thus, in one embodiment, the voltage applied to ECE 34 can be of an amount such that the electric fields present at both sides of meshed grid 32 are equal to one another, allowing for optimized control of emittance growth in electron beam 28.

ECE 34 also functions to allow for increased beam current modulation of electron beam 28 in field emitter unit 10. That is, ECE 34 allows for current density in electron beam 28 to be increased to higher levels without suffering an associated degradation in beam quality. When an extraction voltage applied to meshed grid 32 by controller 21 is changed to modulate electron beam current, the compression voltage applied to ECE 34 can also be changed so as to minimize emittance growth in electron beam 28. That is, when the current density in electron beam 28 is increased by way of an increased extraction voltage being applied to extraction electrode 20 and meshed grid 32 by controller 21, the compression voltage applied to ECE 34 is also increased so as to allow for greater compression of electron beam 28 and to minimize emittance growth therein. By associating the voltage supplied to extraction electrode 20 and meshed grid 32 with the voltage supplied to ECE 34, beam quality can always be preserved at different beam current densities. It is also envisioned, however, that rather than varying a voltage applied to ECE 34, it is also possible that the voltage applied to ECE 34 be fixed relative to the varied voltage applied to extraction electrode 20 and meshed grid 32. Applying such a fixed voltage to ECE 34 allows for a slight change of the electron beam emittance, the amount of which can be controlled by an operator to a desired value.

As also shown in FIG. 1, a focusing electrode 56 is included in field emitter unit 10 and is positioned downstream from ECE 34 to further compress a cross-sectional area of the electron beam. The focusing electrode 56 is energized by a separate voltage controller (not shown) from the controllers that energize the ECE and extraction electrode (i.e., controllers 21, 54). Focusing electrode 56 functions to focus electron beam 28 as it passes through an aperture 58 formed therein. The size of aperture 58 and thickness of focusing electrode 56 are designed such that maximum electron beam focusing can be achieved. Additionally, the shape of aperture 58 can be circular, rectangular, or shaped otherwise, so as to control a shape of a desired focal spot 60 on a target anode 62. A voltage is applied to focusing electrode 56 to focus electron beam 28 by way of an electrostatic force such that the electron beam 28 is focused to form the desired focal spot 60 on the target anode 62. As shown in FIG. 1, focusing electrode 56 is separated from ECE 34 by a distance (e.g., 5-15 cm) that allows for optimized focusing of electron beam 28 into a useable focal spot 60. To provide separation between focusing electrode 56 and ECE 34, a spacer element 64 can be placed therebetween having a desired thickness.

The target anode 62 can be a stationary target or a rotating target for high power application. The target anode 62 can comprise a single plate, or alternatively, can comprise a hooded target that is surrounded by a target shield (not shown). The target shield would provide better capture of secondary electron beams and ions generated from the target anode 62 when the primary electron beam impinges thereon, as well as provide improved high voltage stability.

Figure 7:
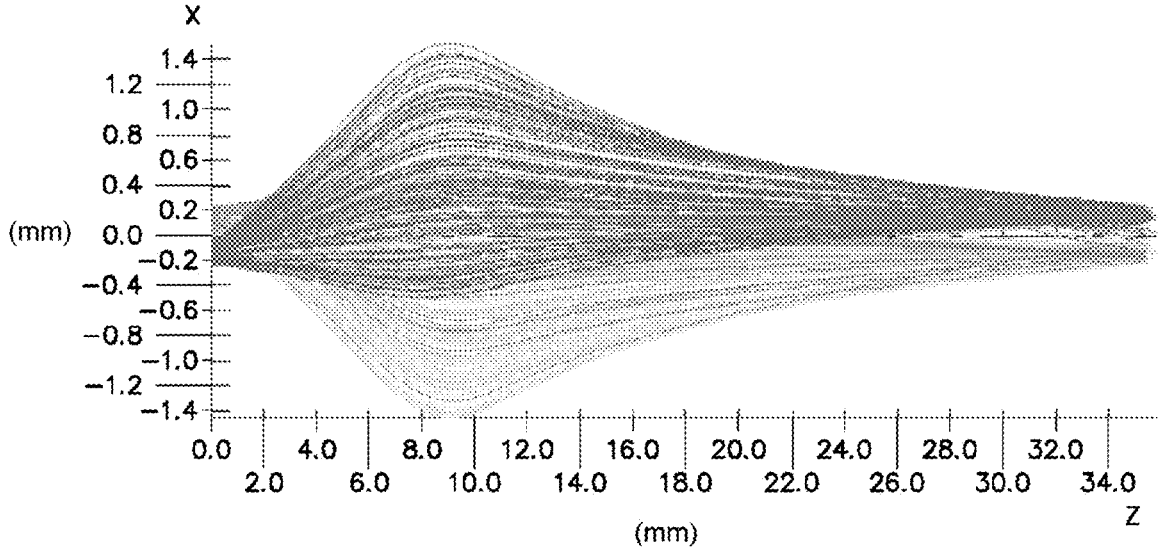
FIG. 7 is a graphical representation of beam trajectory and compression in a field emitter unit not having an ECE.
Figure 8:
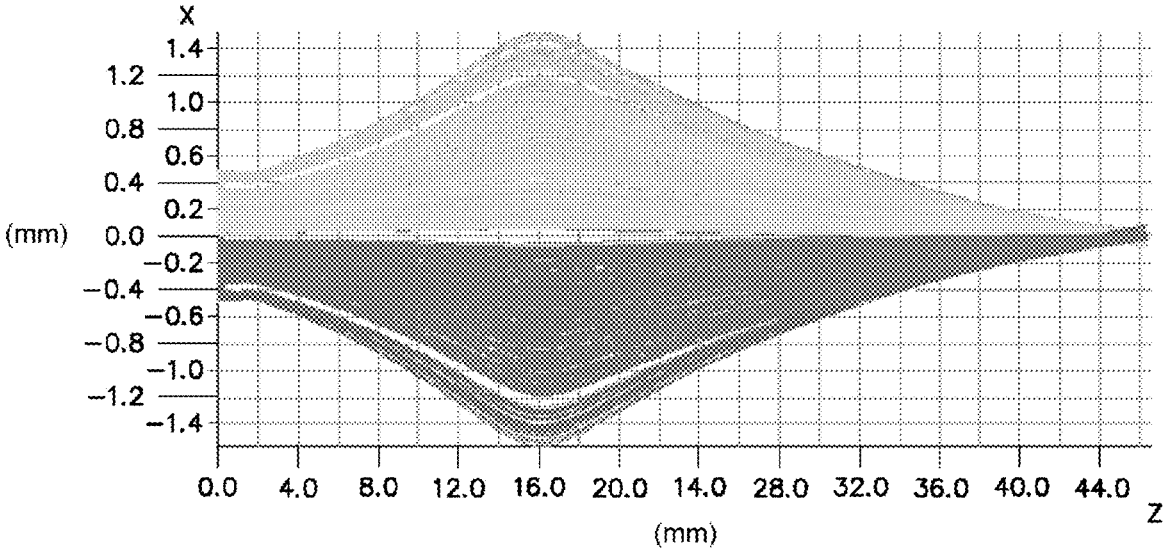
FIG. 8 is a graphical representation of beam trajectory and compression in a field emitter unit having an ECE.

Referring now to FIGS. 7 and 8, a graphical representation of the improved beam focusing provided by the ECE described above is shown. FIG. 7 displays an example of an electron beam trajectory in a field emitter unit without inclusion of an ECE. In the example shown, the beam area compression is around 1 times (1×), with the emitter size=0.5 mm in diameter and the spot size=0.46 mm in diameter. The beam emittance grows to 6.25 mm-mrad at a target anode. FIG. 8 displays an example of an electron beam trajectory in a field emitter unit that includes an ECE, such as the ECE described in detail above. In the example shown, the electron beam is focused onto a small spot size by way of a beam area compression of around 70 times (70×), with the emitter size=1 mm in diameter and the spot size=0.12 mm in diameter. The beam emittance growth at a target anode is only 1.2 mm-mrad with the ECE. The display of the compression ratio and emittance growth of an electron beam shown in FIGS. 7 and 8 are merely examples and are provided to show the improved beam quality possible by way of ECE 34 (shown in FIG. 1). It is envisioned that a greater maximum compression ratio and a lesser emittance growth for the electron beam are possible by way of the ECE.

Figure 9:
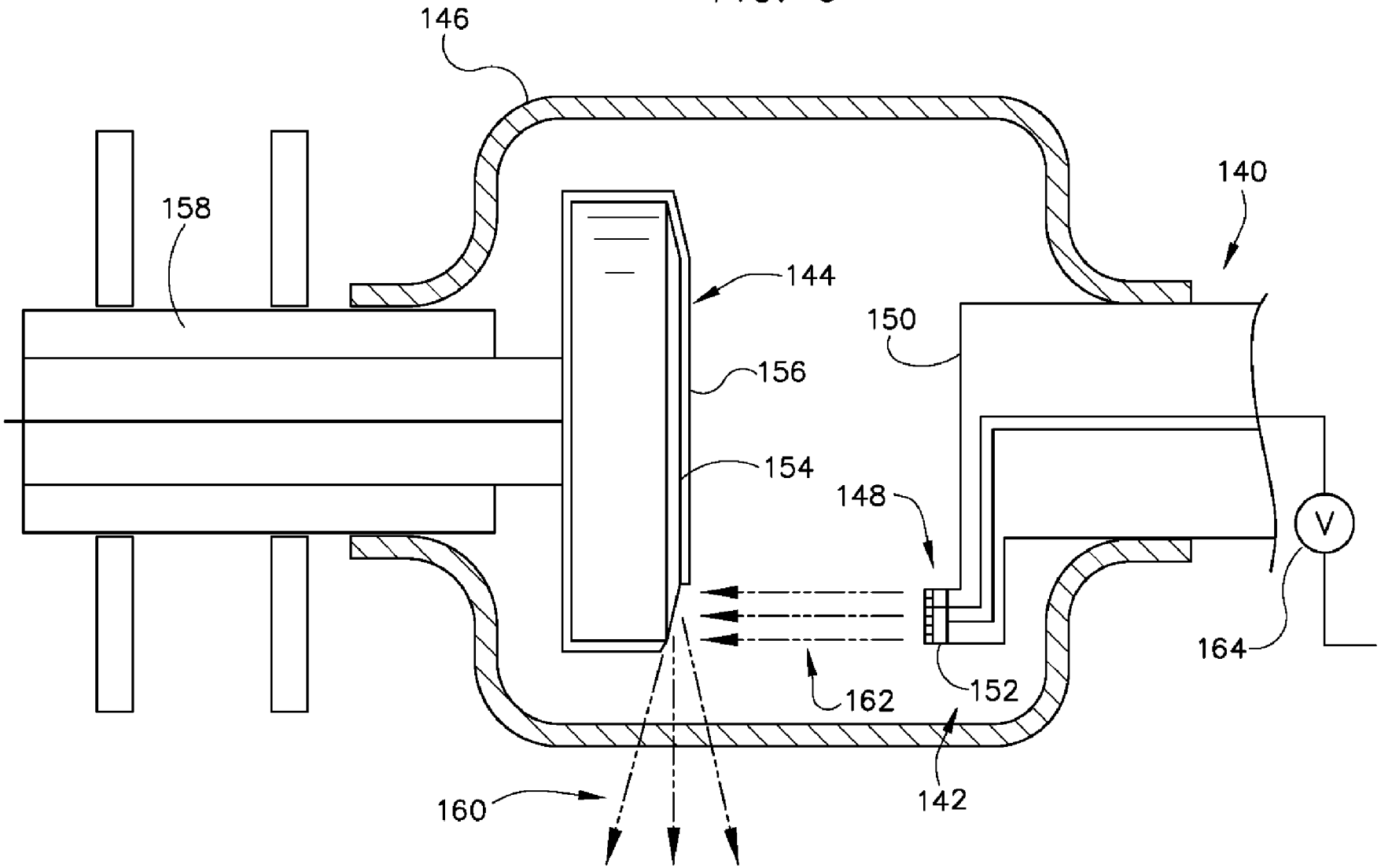
FIG. 9 is a schematic view of an x-ray source in accordance with an embodiment of the present invention.

Referring now to FIG. 9, an x-ray generating tube 140, such as for a CT system, is shown. Principally, x-ray tube 140 includes a cathode assembly 142 and an anode assembly 144 encased in a housing 146. Anode assembly 144 includes a rotor 158 configured to turn a rotating anode disc 154 and anode shield 156 surrounding the anode disc, as is known in the art. When struck by an electron current 162 from cathode assembly 142, anode 156 emits an x-ray beam 160 therefrom. Cathode assembly 142 incorporates an electron source 148 positioned in place by a support structure 150. Electron source 148 includes an array of field emitter units 152 to produce a primary electron current 162, such as the field emitter units described in detail above. Further, with multiple electron sources, the target does not have to be a rotating target. Rather, it is possible to use a stationary target with electron beam is turned on sequentially from multiple cathodes. The stationary target can be cooled directly with oil or water or other liquid.

Figure 10:
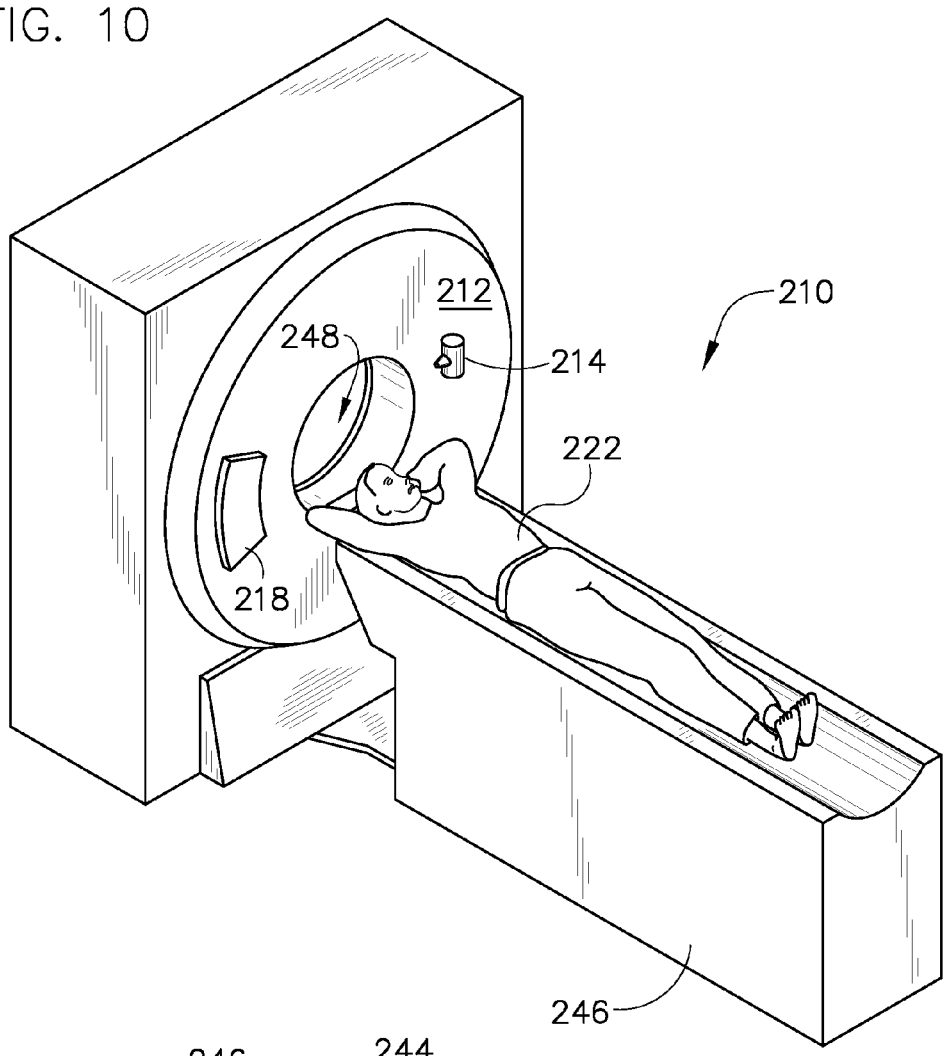
FIG. 10 is a perspective view of a CT imaging system incorporating an embodiment of the present invention.
Figure 11:
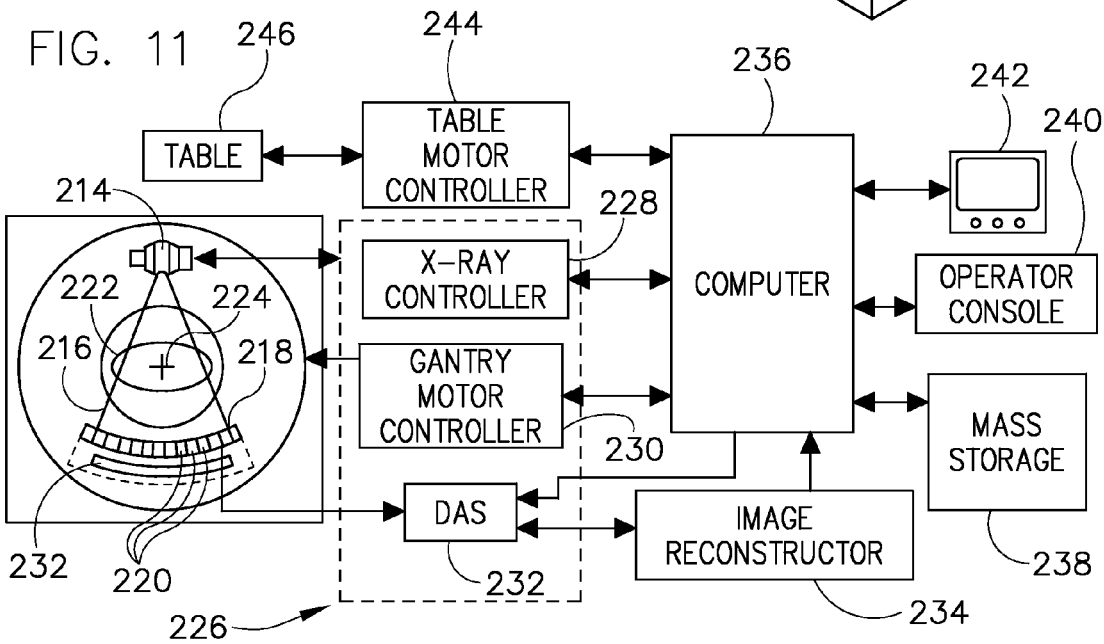
FIG. 11 is a schematic block diagram of the system illustrated in FIG. 10.

Referring to FIG. 10, a computed tomography (CT) imaging system 210 is shown as including a gantry 212 representative of a "third generation" CT scanner. Gantry 212 has an x-ray source 214 that rotates thereabout and that projects a beam of x-rays 216 toward a detector assembly or collimator 218 on the opposite side of the gantry 212. X-ray source 214 includes an x-ray tube having a field emitter based cathode constructed as in any of the embodiments described above. Referring now to FIG. 11, detector assembly 218 is formed by a plurality of detectors 220 and data acquisition systems (DA232. The plurality of detectors 220 sense the projected x-rays that pass through a medical patient 222, and DAS 232 converts the data to digital signals for subsequent processing. Each detector 220 produces an analog electrical signal that represents the intensity of an impinging x-ray beam and hence the attenuated beam as it passes through the patient 222. During a scan to acquire x-ray projection data, gantry 212 and the components mounted thereon rotate about a center of rotation 224.

Rotation of gantry 212 and the operation of x-ray source 214 are governed by a control mechanism 226 of CT system 210. Control mechanism 226 includes an x-ray controller 228 that provides power, control, and timing signals to x-ray source 214 and a gantry motor controller 230 that controls the rotational speed and position of gantry 212. X-ray controller 228 is preferably programmed to account for the electron beam amplification properties of an x-ray tube of the invention when determining a voltage to apply to field emitter based x-ray source 214 to produce a desired x-ray beam intensity and timing. An image reconstructor 234 receives sampled and digitized x-ray data from DAS 232 and performs high speed reconstruction. The reconstructed image is applied as an input to a computer 236 which stores the image in a mass storage device 238.

Computer 236 also receives commands and scanning parameters from an operator via console 240 that has some form of operator interface, such as a keyboard, mouse, voice activated controller, or any other suitable input apparatus. An associated display 242 allows the operator to observe the reconstructed image and other data from computer 236. The operator supplied commands and parameters are used by computer 236 to provide control signals and information to DAS 232, x-ray controller 228 and gantry motor controller 230. In addition, computer 236 operates a table motor controller 244 which controls a motorized table 246 to position patient 222 and gantry 212. Particularly, table 246 moves patients 222 through a gantry opening 248 of FIG. 9 in whole or in part.

While described with respect to a sixty-four-slice "third generation" computed tomography (CT) system, it will be appreciated by those skilled in the art that embodiments of the invention are equally applicable for use with other imaging modalities, such as electron gun based systems, x-ray projection imaging, package inspection systems, as well as other multi-slice CT configurations or systems or inverse geometry CT (IGCT) systems. Moreover, the invention has been described with respect to the generation, detection and/or conversion of x-rays. However, one skilled in the art will further appreciate that the invention is also applicable for the generation, detection, and/or conversion of other high frequency electromagnetic energy.

Therefore, according to one embodiment of the invention, an electron gun includes an emitter element configured to generate an electron beam and an extraction electrode positioned adjacent to the emitter element to extract the electron beam out therefrom, the extraction electrode including an opening therethrough. The electron gun also includes a meshed grid disposed in the opening of the extraction electrode to enhance intensity and uniformity of an electric field at a surface of the emitter element and an emittance compensation electrode (ECE) positioned adjacent to the meshed grid on the side of the meshed grid opposite that of the emitter element and configured to control emittance growth of the electron beam.

According to another embodiment of the invention, a cathode assembly for an x-ray source includes a substrate, an extraction element positioned adjacent to the substrate and having an opening with a meshed grid positioned therein, and an insulating layer between the substrate and the extraction element, the insulating layer having a cavity generally aligned with the opening in the extraction element. The cathode assembly also includes a field emitter element disposed in the cavity of the insulating layer and configured to emit a stream of electrons when an emission voltage is applied across the extraction element and an emittance compensation electrode (ECE) positioned downstream from the extraction element and configured to compress the electron beam in space and momentum phase space.

According to yet another embodiment of the invention, a multiple spot x-ray source includes a plurality of field emitter units configured to generate at least one electron beam and a target anode positioned in a path of the at least one electron beam and configured to emit a beam of high-frequency electromagnetic energy conditioned for use in a CT imaging process when the electron beam impinges thereon. Each of the plurality of field emitter units includes a carbon nanotube (CNT) emitter element and a gate electrode to extract the electron beam from the CNT emitter element, the gate electrode including a meshed grid positioned in the electron beam path. Each of the plurality of field emitter units further includes a focusing element positioned to receive the electron beam from the emitter element and focus the electron beam to form a focal spot on the target anode and an emittance compensation electrode (ECE) positioned between the meshed grid and the focusing element and configured to control electron beam emittance growth.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

What is claimed is:

1. An electron gun comprising:

an emitter element configured to generate an electron beam;

an extraction electrode positioned adjacent to the emitter element to extract the electron beam out therefrom, the extraction electrode including an opening therethrough;

a meshed grid disposed in the opening of the extraction electrode to enhance intensity and uniformity of an electric field at a surface of the emitter element;

an emittance compensation electrode (ECE) positioned adjacent to the meshed grid on the side of the meshed grid opposite that of the emitter element and configured to control emittance growth of the electron beam; and a controller configured to:

cause a voltage to be applied to the extraction electrode to generate a desired current density in the electron beam;

determine a voltage to be applied to the ECE, said voltage chosen so as to minimize emittance growth of the electron beam based on the voltage applied to the extraction electrode; and cause the determined voltage to be applied to the ECE such that electric fields present at opposing sides of the meshed grid are equal.

2. The electron gun of claim 1 wherein the ECE includes an aperture therein to allow the electron beam to pass through the ECE.

3. The electron gun of claim 2 wherein the aperture comprises an angled opening.

4. The electron gun of claim 2 wherein the ECE further comprises a secondary grid positioned in the aperture, the secondary grid including a plurality of openings therein that are aligned with openings in the meshed grid along a path of the electron beam.

5. The electron gun of claim 1 wherein the controller is configured to cause a constant voltage to be applied to the ECE such that emittance growth of the electron beam varies when a varied voltage is applied to the extraction electrode.

6. The electron gun of claim 1 further comprising a focusing electrode positioned to receive the electron beam after passing through the ECE and configured to focus the electron beam to form a focal spot on a target anode.

7. The electron gun of claim 6 wherein the focusing electrode is configured to compress a cross-sectional area of the electron beam.

8. The electron gun of claim 1 wherein the emitter element comprises a one of a carbon nano-tube (CNT) field emitter, a dispenser cathode, and a thermionic cathode.

9. The electron gun of claim 1 wherein the controller is configured to cause the determined voltage to be applied to the ECE such that electrons in the electron beam are compressed in a transverse direction and caused to have nearly the same momentum.

10. The electron gun of claim 1 wherein the compression voltage applied across the ECE is between 4 and 20 kV.

11. A cathode assembly for an x-ray source comprising:

a substrate;

an extraction element positioned adjacent to the substrate and having an opening with a meshed grid positioned therein;

an insulating layer between the substrate and the extraction element, the insulating layer having a cavity generally aligned with the opening in the extraction element;

a field emitter element disposed in the cavity of the insulating layer and configured to emit an electron beam when an emission voltage is applied across the extraction element;

an emittance compensation electrode (ECE) positioned downstream from the extraction element and configured to compress the electron beam in space and momentum phase space; and a controller configured to:

control the emission voltage applied across the extraction element;

determine a voltage to be applied to the ECE, said voltage chosen so as to minimize emittance growth of the electron beam based on the voltage applied to the extraction element; and, control the compression voltage applied across the ECE to vary compression of the electron beam, the compression voltage applied across the ECE being associated with the emission voltage applied across the extraction electrode and being controlled by the controller to compress the electron beam in space and momentum phase space so as to minimize emittance growth thereof.

12. The cathode assembly of claim 11 wherein the controller is configured to control the emission voltage applied across the extraction element to modulate electron beam current density.

13. The cathode assembly of claim 11 wherein the ECE is further configured to generate a variable electrostatic field having a strength determined by the amount of compression voltage applied across the ECE.

14. The cathode assembly of claim 11 further comprising a focusing element positioned to receive the electron beam from the field emitter element and to focus the electron beam to form a focal spot on a target anode.

15. The cathode assembly of claim 11 wherein the ECE further comprises a secondary grid, the secondary grid including a plurality of openings therein that are aligned with openings in the meshed grid along a path of the electron beam.

16. A multiple spot x-ray source comprising:

a plurality of field emitter units configured to generate at least one electron beam;

a target anode positioned in a path of the at least one electron beam and configured to emit a beam of high-frequency electromagnetic energy conditioned for use in a CT imaging process when the electron beam impinges thereon; and wherein each of the plurality of field emitter units further comprises:

a carbon nanotube (CNT) emitter element including a plurality of CNT groups;

a gate electrode to extract the electron beam from the CNT emitter element, the gate electrode including a meshed grid positioned in the electron beam path and relative to the CNT emitter element such that each of the plurality of CNT groups is aligned with a respective opening in the meshed grid;

a focusing element positioned to receive the electron beam from the emitter element and focus the electron beam to form a focal spot on the target anode;

an emittance compensation electrode (ECE) positioned between the meshed grid and the focusing element and configured to control electron beam emittance growth; and, wherein the field emitter unit further comprises a controller configured to apply a variable voltage to at least one of the gate electrode and the ECE to modulate current density in the electron beam and control electron beam emittance growth, respectively and wherein the voltage applied to the ECE by the controller is determined such that the voltage to be applied to the gate electrode is chosen so as to control emittance growth of the electron beam.

17. The multiple spot x-ray source of claim 16 wherein the ECE includes an aperture therein, the aperture having a shape substantially similar to a shape of the electron beam.

18. The multiple spot x-ray source of claim 17 wherein the aperture comprises an angled opening.

19. The multiple spot x-ray source of claim 17 wherein the ECE further comprises a secondary grid positioned in the aperture, the secondary grid including a plurality of openings therein that are aligned with openings in the meshed grid along a path of the electron beam.

20. The multiple spot x-ray source of claim 16 wherein the ECE is configured to provide area compression to the electron beam to minimize a size of the focal spot on the target anode.

21. The cathode assembly of claim 11 wherein the controller is configured to control a compression voltage applied across the ECE to compress electrons in the electron beam in a transverse direction and cause the electrons to have nearly the same momentum, so as to minimize emittance growth of the electron beam.

22. The multiple spot x-ray source of claim 16 wherein the controller is configured to apply a voltage to the ECE to compress electrons in the electron beam in a transverse direction and cause the electrons to have nearly the same momentum.

* * * * *

UNITED STATES PATENT AND TRADEMARK OFFICE

CERTIFICATE OF CORRECTION

PATENT NO. : 7,801,277 B2
APPLICATION NO. : 12/055536
DATED : September 21, 2010
INVENTOR(S) : Zou et al.

It is certified that error appears in the above-identified patent and that said Letters Patent is hereby corrected as shown below:

In Fig. 8, Sheet 3 of 5, delete " 20.0 14.0 (mm) " and insert -- 20.0 24.0 (mm) --, therefor.

In Column 7, Line 17, delete "(DA232." and insert -- (DAS232). --, therefor.

In Column 10, Lines 9-15, in Claim 11, delete "applied across the ECE.....growth thereof." and insert the same at Line 8, after "compression voltage", as a continuation of the Paragraph.

Signed and Sealed this

Sixteenth Day of November, 2010

David J. Kappos

David J. Kappos
*Director of the United States Patent and Trademark Office*